United States Patent [19]

Lyaudet et al.

[11] 4,256,702

[45] Mar. 17, 1981

[54] PROCESS FOR THE SEPARATION OF URANIUM CONTAINED IN AN ALKALINE LIQUOR

[75] Inventors: Georges Lyaudet, Chilly Mazarin; Jean Vial, Clamart, both of France

[73] Assignee: Compagnie Generale des Matieres Nucleaires (Cogema), Paris, France

[21] Appl. No.: 876,157

[22] Filed: Feb. 8, 1978

[30] Foreign Application Priority Data

Feb. 9, 1977 [FR] France ..... 77 03639

[51] Int. Cl.[2] ..... C01G 43/00

[52] U.S. Cl. ..... 423/7; 423/15; 423/17

[58] Field of Search ..... 423/7, 15, 17

[56] References Cited

U.S. PATENT DOCUMENTS

| | | | |
|---|---|---|---|
| 2,863,717 | 12/1958 | Kunin | 423/7 |
| 2,900,227 | 8/1959 | Doney et al. | 423/7 |
| 2,982,605 | 5/1961 | Mouret et al. | 423/7 |
| 3,000,696 | 9/1961 | Teichmann | 423/7 |
| 3,445,201 | 5/1969 | Wheelwright | 423/7 |
| 3,961,027 | 6/1976 | Crossley | 423/7 |

FOREIGN PATENT DOCUMENTS

| | | | |
|---|---|---|---|
| 1373734 | 8/1964 | France | 423/7 |
| 775415 | 5/1957 | United Kingdom | 423/7 |

*Primary Examiner*—Edward A. Miller

*Attorney, Agent, or Firm*—Ernest G. Szoke

[57] ABSTRACT

Uranium is recovered from alkaline leach liquors of uranium ores by treating the leach liquors with an ion exchange resin in the ammonium form to provide a solution of salts and complexes of uranium and ammonium from which the uranium is separated by treating with heat or an acid.

11 Claims, No Drawings

PROCESS FOR THE SEPARATION OF URANIUM CONTAINED IN AN ALKALINE LIQUOR

The invention relates to a process for recovering uranium from a solution in which it is contained in the form of solubilized salts or complexes, or both of uranium and of an alkaline metal, particularly from the extraction alkaline leach liquor of uranium ores.

This process comprises contacting the solution with a cationic ion exchange resin in the ammonium form and collecting, after the ion exchange has taken place, the solution containing the uranium in the form of salts or complexes (or both) of uranium and ammonium. The uranium can then be recovered under different conventional forms from the solution so obtained.

The invention relates to a process for the separation of the uranium contained in an alkaline liquor. It relates more particularly to the separation of uranium from the liquor obtained after the attack, particularly leaching, of a uraniferous ore, by means of a solution containing a carbonate and/or bicarbonate of an alkaline metal such as sodium in the presence of an oxidant. It is known that such process leads to alkaline solutions in which the uranium is present in the form of sodium uranyl-tricarbonate.

The separation of the uranium contained in these solutions is effected conventionally by the addition of sodium hydroxide to the uraniferous liquor, which results in the precipitation of the uranium in the form of one or several sodium uranates.

The precipitation of the uranium in this form is not generally quantitative, and this drawback is most often overcome by subjecting the residual liquor to another carbonatation, and by recycling the carbonated solution back to the leaching stage of the ore.

It is known however that when the treated ores contain sulfur, notably in the states of sulfides or of sulfates, the successive recyclings of the alkaline extraction liquors will cause the latter to become progressively enriched in sodium sulfate to such an extent that, when the sulfate contents exceed certain thresholds, the installation should be purged, thereby resulting in losses both of uranium and of sodium carbonate.

It is an object of the invention to provide a simplified and substantially quantitative process for the separation of the uranium contained in the alkaline extraction, particularly leach solutions of the ore, that is to say a process which is no longer dependent on the recycling of the alkaline liquors to reduce the uranium losses. In addition, the invention aims at providing a process applicable substantially without losses to alkaline extraction solutions obtained from the attack or leach of uranium ores having high contents of compounds containing sulfur and/or organic materials.

The process according to the invention for the treatment of an uraniferous liquor containing uranium in the form of solubilized salts and/or complexes of an alkali metal, particularly sodium, such as sodium-uranyl-tricarbonate, comprises contacting this liquor with a cationic ion exchange resin, previously converted to the ammonium form, and collecting, when the ion exchange is effected, a solution in which the salts and/or complexes previously of the alkali metal, particularly sodium, have been essentially converted into salts and/or complexes of ammonium.

Particularly sodium uranyl-tricarbonate is converted into ammonium uranyl-tricarbonate in the course of this treatment.

The ammonium complex, notably the uranyl-tricarbonate, can then be separated quantitatively from the solution obtained after the abovesaid ion exchange.

Any strong cationic resin withstanding both carbonate-containing solutions, particularly at a pH between about 9.5 and about 10, and the corresponding alkaline solutions containing sodium hydroxide and other organic materials, if any, possibly extracted together with the uranium from the ore, can be used for running the process according to the invention.

Suitable resins are more particularly constituted by the sulfonic cationic resins. Advantageously, the polymer matrix of such strongly acid resins is formed of a styrene and divinylbenzene copolymer. They may be either in the form of a gel without porosity, or in porous form, for example in a macro-crosslinked form with true pores of large sizes. Suitable resins, cited merely by way of example, are those marketed by the ROHM & HAAS company under the designations IR-120, IR-122 and IR-124.

If, as is customary, the cationic ion exchange resin is initially simply represented by the formula R-$NH_4$ the following chemical equations can be resorted to for understanding the transformations which the main sodium constituents contained in this liquor undergo in the course of the cation exchange on the resin.

$$_2R-NH_4+Na_2SO_4 \rightarrow {}_2R-Na+(NH_4)_2SO_4 \quad (1)$$

$$_2R-NH_4+Na_2CO_3 \rightarrow {}_2R-Na+(NH_4)_2CO_3 \quad (2)$$

$$R-NH_4+NaOH \rightarrow R-Na+NH_4OH \quad (3)$$

$$_4R-NH_4+Na_4UO_2(CO_3)_3 \rightarrow {}_4R-Na+(NH_4)_4UO_2(CO_3)_3 \quad (4)$$

A particularly advantageous method for recovering the uranium from the solution obtained which contains the ammonium salts and/or complexes of uranium, consists of a heat treatment of the liquor, preferably at reflux temperature. The uranium is then precipitated in the form of a concentrated ammonium diuranate. This heat treatment produces also the decomposition of the ammonium carbonate into ammonia and carbon dioxide, which can be recovered for producing part of the ammonium carbonate necessary for producing the solution required for regenerating the cationic resin.

In a second type of preferred methods, the liquid containing the ammonium uranyl-tricarbonate is heated and acidified with sulfuric acid to a pH preferably of the order of 2.5 or even less, whereby the uranium compound is converted into soluble uranyl sulfate and the ammonium carbonate initially contained in the treated liquor is decomposed. The uranium sulfate can then, in a manner known per se, be precipitated by magnesia in the form of magnesium uranate. As in the preceding case, the carbon dioxide released as a result of the acidification of the medium, and the ammonia released during the conversion step of the uranyl sulfate into magnesium uranate, may be recycled to the production of ammonium carbonate, which may be used for producing a regenerating solution for the ion exchange resin.

It goes without saying that any other known process may be used for the separation of the uranium from either the still alkaline solution containing the uranium in the state of ammonium uranyl-tricarbonate, or from the acidified uranyl-sulfate solution. It is possible for example to resort to extraction processes employing organophosphorus solvents, such as di(ethylhexyl)-phosphoric acid and to recover the uranium therefrom.

The process according to the invention is most advantageous when the uranium concentrate obtained is not contaminated by metal ions, such as molybdenum. In such favorable situation, the process according to the invention enables the direct and almost quantitative production of a uranium concentrate devoid of metal ions.

This quantitative separation can nevertheless still be secured, even when the solution of the ammonium-uranium-compounds also contains constituents, such as molybdenum, that must be separated.

This separation can take place in any manner known per se.

Whether uranium separation is effected by the abovesaid heat treatment, or by the abovesaid sulfuric acid treatment including the subsequent precipitation of the uranium in the form of magnesium uranate, if the precipitate is contaminated with molybdenum, the molybdenum can be suitably separated upon splitting or disintegrating the solid uranium-containing precipitate within a dilute solution of sulfuric acid, at a pH of from about 2.5 to about 3.5, for instance at pH3, at a temperature below about 50° C. and in the presence of hydrogen peroxide. The latter must be taken in a sufficient amount to cause the selective solubilization of the molybdenum compounds in the medium, so that the solid fraction of the suspension containing the uranium is thereby impoverished in molybdenum, i.e. the solid fraction is freed of a part of the molybdenum that it contained, and preferably even essentially freed of this molybdenum, and is then recoverable from the acidified suspension.

Whatever the process contemplated and the nature of the contaminants which must be separated from the uranium concentrate obtained, the process according to the invention is advantageous in that it comprises but a limited number of operations for extracting the uranium contained in the uraniferous extraction solutions or liquors, all of these steps being operable with substantially quantitative yields.

The process according to the invention can be applied successfully even to uraniferous leach liquors of ores containing both sulfur compounds and organic materials which, as is well known, are particularly difficult to process. In particular, it is applicable with advantage to ores which, such as those of the Herault area (France), have carbonates contents (essentially conventional dolomite or a ferruginous dolomite of the ankerite type), expressed as $CO_2$, from about 5 to 10% by weight and contents of organic components, from about 1 to about 5% by weight, which components comprise constituents with a more or less marked graphitic character, hydrocarbons and various organic reducing agents, among which organic acids, denoted as "humic acids" and which, by alkaline attack and oxidation, are transformed into soluble "humates".

EXAMPLE

Treatment of a Uraniferous Liquor

| The treated liquor has the following composition: | |
|---|---|
| $Na_2So_4$ | 40.1 g/l |
| $Na_2CO_3$ | 4.93 g/l |
| NaHCO | 7.47 g/l |

-continued

| The treated liquor has the following composition: | |
|---|---|
| $Na_4UO_2(CO_3)_3$ | 5.76 g/l, |
| namely | U = 2,53 g/l |
| Mo in the form of molybdates | 130 ppm. |

The resin used was that commercialized by the ROHM & HAAS company under the designation $IR_{120}$, whose capacity in milliequivalents (meq) is in the neighborhood of 2. Tests were carried out with a column having a volume of 92 $cm^3$, a height of 13 cm and a diameter of 3 cm.

The tests were carried out by percolating the solution through the resin column, at flow rates indicated in the table hereafter.

Examination of the results shows that the loading capacity of the resin in sodium ions was not altered by the presence of uranium. The residual uranium content of the resin was 11 mg per liter, which represents 0.6% of the amount of uranium which had been circulated through the resin. The molybdenum was not fixed.

The uranium contained in the eluted solution was carried out by heating the latter and keeping it at boiling point for about 1 to about 4 hours, which caused precipitation of most of the uranium present in the form of ammonium diuranate.

The ammonium diuranate obtained was then treated as indicated above, to free it from the major part of the molybdenum that it contained.

The resin was regenerated by elution with a solution comprising about 100 grams per liter of ammonium carbonate. It was ready for the processing of a new charge of alkaline liquor.

TABLE

| N° | Volume of flow | content of Na (mg/l) | content in resin (mg/l) U | Mo |
|---|---|---|---|---|
| 1 | 0.65 | 12 800 | 7 | traces |
| 2 | 1.25 | 21 900 | 5 | " |
| 3 | 1.81 | 28 000 | 4 | " |
| 4 | 2.35 | 16 400 | 4 | " |
| 5 | 2.89 | 8 550 | 1 | " |
| 6 | 3.41 | 3 730 | 1 | " |
| 7 | 3.91 | 1 560 | <1 | " |
| 8 | 4.40 | 780 | <1 | " |
| 9 | 4.89 | 330 | <1 | " |
| 10 | 5.39 | 140 | <1 | " |
| 11 | 5.89 | 90 | <1 | " |
| 12 | 6.32 | 80 | <1 | " |

We claim:

1. A process for the treatment of an alkaline uraniferous solution, said solution comprising dissolved uranium and alkaline metal salts, dissolved uranium and alkaline metal complexes, or both, which comprises contacting said solution with a cationic ion exchange resin, initially in the ammonium form, to cause exchange of the alkaline metal ions of said salts, complexes, or both, and of the ammonium ions of said ion exchange resin, and after the ion exchange has been effected, collecting a solution comprising dissolved salts of uranium and ammonia, dissolved complexes of uranium and ammonia, or both.

2. The process of claim 1 wherein the ion exchange resin is a sulfonic cationic resin.

3. The process of claim 1 which further comprises separating the salts, complexes, or both, of uranium and ammonia, from the solution obtained after the ion exchange has been effected.

4. A process according to any one of claims 1 to 3 wherein the initial alkaline uraniferous solution is a sodium-uranyl-tricarbonate complex and the solution collected after the ion exchange has been effected is a solution comprising an ammonium-uranyl-tricarbonate complex.

5. A process according to claim 4 which comprises further treating the solution comprising said ammonium-uranyl-tricarbonate complex by heating to produce thermal decomposition thereof and recovering the resulting precipitate which comprises ammonium diuranate.

6. A process according to claim 1 which comprises further treating the solution comprising said ammonium-uranyl-tricarbonate complex by acidifying with sulfuric acid to convert said complex into a uranyl sulfate and recovering the acidified solution containing the uranyl sulfate dissolved therein.

7. A process according to claim 6 which comprises further treating said acidified solution containing uranyl sulfate with magnesium hydroxide to precipitate the uranyl sulfate from said acidified solution and recovering the precipitate containing magnesium uranate.

8. A process according to claim 6 which comprises treating said acidified solution containing uranyl sulfate with an organo-phosphorous solvent to extract the uranyl sulfate and recovering the uranium from said solvent.

9. A process according to claim 5 wherein the precipitate comprises ammonium diuranate contaminated with molybdenum from the initial alkaline uraniferous solution, said process further comprising treating said contaminated precipitate with a solution of sulfuric acid having a pH between about 2.5 and about 3.5 at a temperature below about 50° C. to form an acid suspension, the solid fraction of said suspension comprising said contaminated precipitate, in the presence of hydrogen peroxide in an amount sufficient to cause the selective solubilization of the molybdenum whereby said solid fraction is freed of a part of the molybdenum that it contained, and thereafter separating the resultant solid fraction from said suspension.

10. A process according to claim 7 wherein the precipitate comprises magnesium uranate contaminated with molybdenum from the initial alkaline uraniferous solution, said process further comprising treating said contaminated precipitate with a solution of sulfuric acid at a pH between about 2.5 and about 3.5 at a temperature below about 50° C. to form an acid suspension, the solid fraction of said suspension comprising said contaminated precipitate, in the presence of hydrogen peroxide in an amount sufficient to cause the selective solubilization of the molybdenum whereby said solid fraction is freed of a part of the molybdenum that it contained, and thereafter separating the resultant solid fraction from said suspension.

11. A process according to claim 1 wherein the alkaline solution comprises liquor obtained after leaching uraniferous ores with alkaline leaching solution.

* * * * *